United States Patent [19]

Centanni

[11] 4,087,041

[45] May 2, 1978

[54] LINED BULK CONTAINER AND LINER THEREFORE

[75] Inventor: Michael J. Centanni, New Orleans, La.

[73] Assignee: The Continental Group, Inc., New York, N.Y.

[21] Appl. No.: 765,423

[22] Filed: Feb. 3, 1977

[51] Int. Cl.[2] ..... B65D 5/56; B65D 25/14

[52] U.S. Cl. ..... 220/441; 229/37 R

[58] Field of Search ..... 229/37, 14 R, 14 BF, 229/14 BL, 14 BA, 23 R

[56] References Cited

U.S. PATENT DOCUMENTS

| | | | |
|---|---|---|---|
| 3,114,494 | 12/1963 | Wasyluka | 229/14 R X |
| 3,125,274 | 3/1964 | Zinn | 229/14 BA |
| 3,281,050 | 10/1966 | Suchdodolski | 229/14 BA X |
| 3,360,181 | 12/1967 | Wilson | 229/37 R |
| 3,559,867 | 2/1971 | Mushopf | 229/14 BL |
| 3,744,702 | 7/1973 | Ellison | 229/23 R |
| 3,910,482 | 10/1975 | Bamburg et al. | 229/14 R |

*Primary Examiner*—Davis T. Moorhead
*Attorney, Agent, or Firm*—Diller, Brown, Ramik & Wight

[57] ABSTRACT

This disclosure relates to a lined bulk container wherein the liner is formed of a single piece of paperboard in sheet form and wherein the paperboard piece is provided with a longitudinal slit-type fold line dividing the same into two halves which are shifted relative to one another longitudinally of the slit-type fold line. The two half portions of the liner are folded relative to one another and are adhesively bonded to each other in face-to-face relation. The two half portions of the liner have aligned transverse fold lines, the fold lines on the half of the liner which forms the inner surface thereof being fold-type score lines and the score lines on the half thereof which forms the outer surface of the liner being of the score and slot type so as to facilitate the folding of the doubled linear. The offsetting of the liner halves provides at one end of the folded liner a notch and at the opposite end a projecting flap which is seatable in the notch and which is bondable to the other half of the liner so as to form a continuous inner surface backed by the outer part of the liner. The liner is received in a conventional type carton and is adhesively bonded to the inner surface thereof. The liner may be formed of double wall corrugated board.

9 Claims, 5 Drawing Figures

LINED BULK CONTAINER AND LINER THEREFORE

This invention relates in general to new and useful improvements in containers for bulk material and more particularly to a bulk container having a liner positioned therein and laminated thereto.

A bulk container has two requirements. First it should have sufficient rigidity and strength so as to support the product contained therein. Secondly, it should have an inner surface which is substantially impervious. These requirements are in addition to the usual requirements of ease of manufacture, ease of set-up, etc.

In accordance with this invention, there is provided a novel liner for use in a bulk container. The liner is formed from a single piece of paperboard in sheet form, preferably corrugated board and the liner blank is provided with suitable scores therein which first of all permits the liner to be folded along a longitudinal fold line so that the two halves of the liner will fold upon themselves. The two halves of the liner are then adhesively bonded to one another so as to increase the compression and stacking strength of the liner as well as to simplify the manufacturing process. The folded liner has aligned score lines in the two halves thereof and that half of the liner which forms the inner surface thereof is provided with a notch at one end and a projecting flap at the opposite end, the projecting flap, when the liner is folded to an enclosing position being seated in the notch and being bonded to the other half of the liner so as to provide for a rigid construction, an impervious construction, and one which is not unduly weakened at a corner. The liner, in turn, is bonded to the inner surface of the carton body.

With the above and other objects in view that will hereinafter appear, the nature of the invention will be more clearly understood by reference to the following detailed description, the appended claimed subject matter, and the several views illustrated in the accompanying drawing.

IN THE DRAWING

FIG. *2a* is an enlarged fragmentary sectional view taken through the wall of the carton body and liner and shows a slightly modified liner construction.

Figure 3:
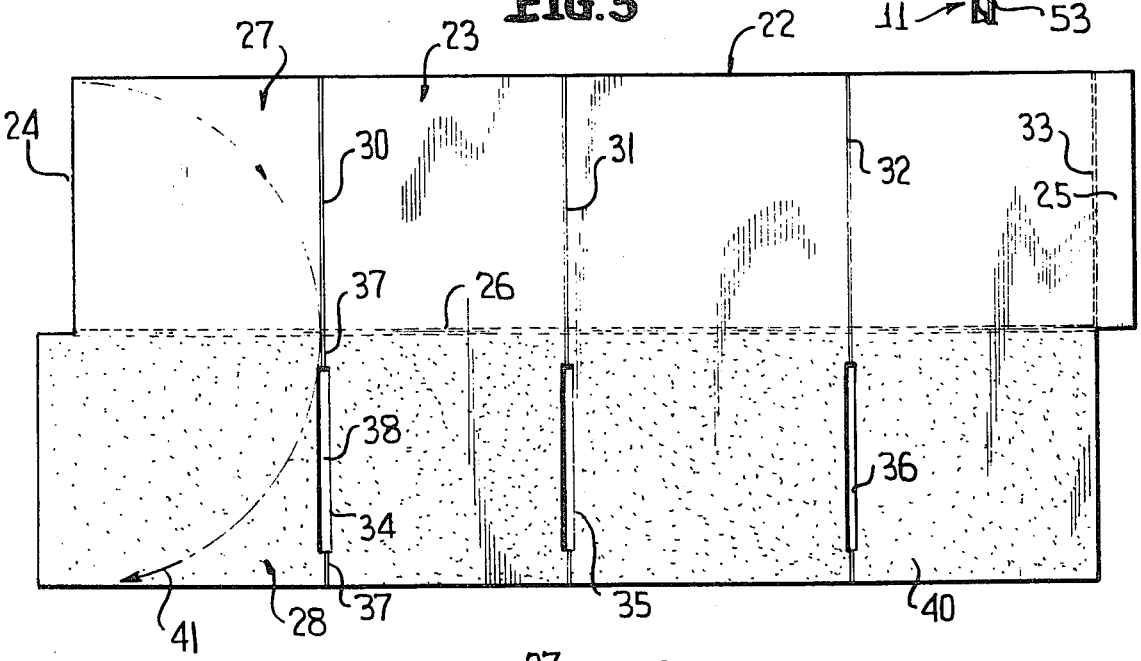

FIG. 3 is a plan view of the liner blank.

Figure 4:
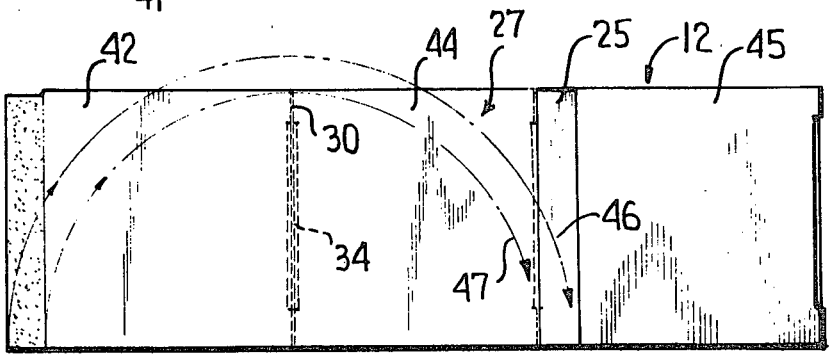

FIG. 4 is a plan view of the liner blank in its initial refolded state with one of the liner panels being further folded relative to the remainder of the liner in the progress of completing the liner construction.

Referring now to the drawing in detail, it will be seen that the container is generally identified by the numeral 10 and includes a container member, generally identified by the numeral 11, a liner, generally identified by the numeral 12, and a cover, generally identified by the numeral 13. Generally speaking, the container member 11 and the cover 13 are of a conventional construction and the description thereof will be held to a minimum.

It is pointed out here that the container member 11 includes basically a container body, generally identified by the numeral 14, and a bottom, generally identified by the numeral 15. The container body 14 is generally rectangular in outline and is formed of a pair of end panels 16 and a pair of side panels 17 with one of the side panels 17 having a flap 18 which is hingedly connected to one edge thereof and is in overlapping bonded relation to the adjacent end panel 16.

The bottom 15 is formed by four flaps which include two flaps 20 hingedly connected to the end panels 16 and two flaps 21 hingedly connected to the side panels 17. The flaps 20, 21 are adhesively bonded to one another to form a sealed bottom.

Reference is now made to the constructional details of the liner 12. The liner 12 is formed from a blank, generally identified by the numeral 22. The blank 22 is in the form of a sheet of paperboard material, the sheet being identified by the numeral 23 and being generally rectangular in outline. The sheet 23 is provided at one corner thereof with a notch 24 and at the longitudinally opposite corner with a projecting flap 25.

The sheet 23 is provided with a centrally located, longitudinally extending fold line 26 which, when the sheet is formed of corrugated board, is in the form of a slit. The details of the fold line 26 will be explained hereinafter. The fold line 26 divides the sheet 23 into two halves 27 and 28 which are longitudinally shifted with respect to one another. It will be seen that the notch 24 is at the end of the half 27 and that the projecting flap 25 is part of the half 27 with the notch 24 and the flap 25 extending the full width of the half 27.

The half 27 is provided with a plurality of transverse scores to define fold lines 30, 31, 32 and 33. In a like manner, the half 28 is provided with fold lines 34, 35 and 36 which are aligned with an form continuations of the fold lines 30, 31, 32, respectively. The fold lines 34, 35 and 36 are defined in part by scores 37 and in part by cutouts or slots 38 as is specifically identified with respect to the fold line 34.

In the forming of the liner 12 from the blank 22, a suitable adhesive 40 is applied to a surface of one of the halves 27, 28 and the sheet 23 is then folded upon itself along the fold line 26 so that, with reference to FIGS. 3 and 4, the half 27 overlies the half 28 and is bonded thereto in face-to-face relation. The folding of the half 27 relative to the half 28 is indicated by the arrow 41.

After the initial folding of the blank 22, the half 27 is disposed uppermost and the liner 12 now includes side panels 42 and 43 and end panels 44 and 45 with the side panel 42 and the end panel 45 being disposed at opposite ends of the liner. Further, the free end of the side panel 42 is of a single thickness while the projecting flap 25 projects from the end of the end panel 45.

The liner 12 thus formed is then folded so that the end panel 45 overlies the side panel 43, after which the side panel 42 is folded to overlie the end panel 44. At this time the flap 25 becomes seated in the notch 24 and is adhesively bonded to the single thickness portion of the side panel 42. Thus the flap 25 becomes in edge opposing relation to the opposite edge of the half 27. It is pointed out here at this time that the flap 25 is of a slightly lesser width than the notch 24 so as to facilitate and assure the seating of the flap 25 within the notch. The folding of the side panel 42 into overlaying relation with respect to both the end panel 44 and the flap 25 is indicated by arrows identified by the numerals 46 and 47. The liner 12 is now complete.

Figure 1:
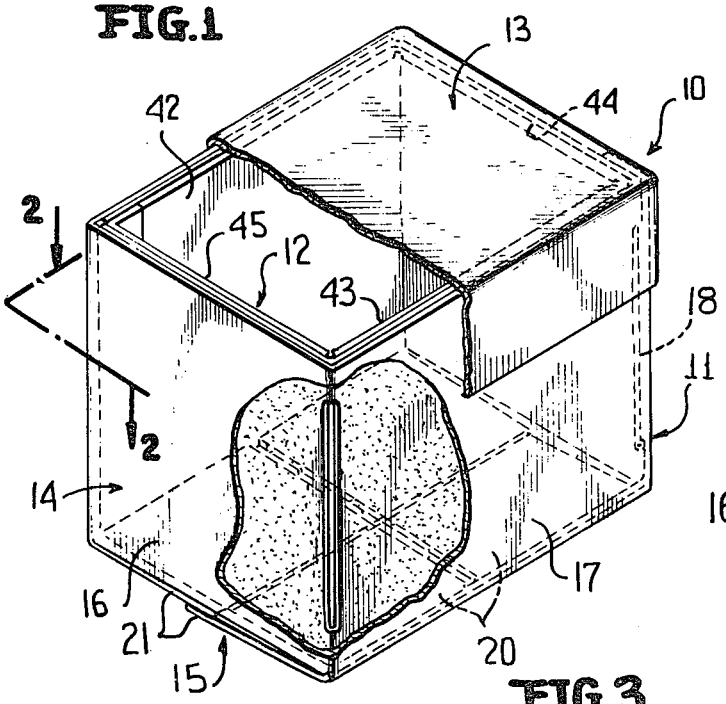
FIG. 1 is a top perspective view of a completed carton with portions broken away and shown in section so as to clearly illustrate the structural details thereof.
Figure 2:
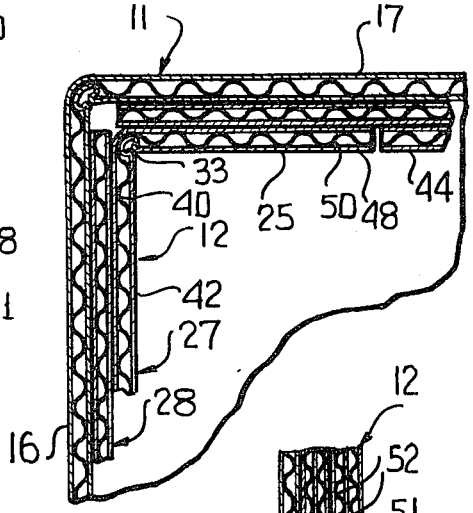
FIG. 2 is an enlarged fragmentary horizontal sectional view taken along the line 2—2 of FIG. 1 and shows specifically the constructional details of one corner of the carton.

At this time reference is made to FIG. 2 wherein the liner 12 is illustrated in transverse cross-section. It is to be noted that the half 27 is disposed innermost with adhesive 40 disposed therebetween. It is also to be noted that the opposite ends of the half 28 are disposed in adjacent relation at a corner of the liner 12. On the other hand, the corner is uninterrupted in that the flap 25 is connected to that portion of the half 27 forming the side panel 42 along the fold line 33. In this manner, the liner 12 is of a sealed construction so as to prevent a bulk material from sifting therethrough while at the same time providing the desired strength for the container body member 11. It is also to be noted that the container member 11 is formed of corrugated board for strength purposes. In addition, the liner 12 is formed of corrugated board. In FIG. 2 the liner 12 is illustrated as being of single wall corrugated board, that is having a single corrugated wall. Thus the corrugated board from which the liner 12 is formed will include a pair of face sheets 48 and an intermediate corrugated wall 50 adhesively bonded to the opposed faces of the face sheets 48. When the liner 12 is so constructed, the fold line 26 is defined by slitting through one of the face sheets 48 and the corrugated wall 50.

In order that the liner 12 may have adequate strength, it may be of double wall corrugated board. That is, corrugated board which has two corrugated walls. Such corrugated board would include three face sheets 51 and two corrugated walls 52. When the blank 22 is formed of double wall corrugated board, the fold line 26 will be defined by slitting through two of the face sheets and two of the corrugated walls. The remaining face sheet would then function as the fold defining material.

Figure 2A:
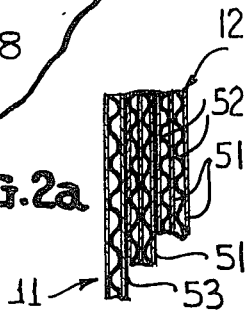

As is clearly illustrated in FIGS. 2 and 2a, the liner 12 has the exterior surface thereof bonded to the interior surface of the container member 11 by means of a further layer of adhesive 53. There are several ways in which the adhesive bonding of the liner 12 to the container member 11 may be effected. A preferred mode of accomplishing this bonding is by bonding the liner 12 in its assembled, flat form to the inner surface of two respective panels of the container member 11 when it is in its flat or blank form. Then folding the other two panels of the container member 11 over the liner to complete the bond between the liner and the container member with the flap 18 being bonded to its respective end panel. Thus the liner 12 may be secured to the container member 11 with the container member in its flat state ready for shipment. The user of the lined container may then readily erect the container, gluing together the bottom panels 20, 21 so as to complete the container ready for receiving the bulk contents. Thereafter the closure 13 is applied and secured in place in any desired manner.

It is particularly pointed out here that the constructional arrangements of the respective folds of the liner blank 22 permits the bonded together halves of the liner, which is now relatively thick, to be readily folded to define the enclosing configuration. At the same time the fold line arrangement of the liner permits the assembling thereof with the container member 11 in the flat state with the container member 11 being readily openable.

Although only a preferred embodiment of the container has been specifically illustrated and described herein, it is to be understood that minor variations may be made therein without departing from the spirit and scope of the invention, as defined by the appended claims.

I claim:

1. A liner blank comprising a generally rectangular sheet, a centrally disposed first fold line extending across said sheet and dividing said sheet into two halves offset from one another longitudinally of said first fold line, one half of said sheet having at one side edge a notch extending the full width of said one half to said first fold line and at an opposite side edge thereof from said notch a projecting flap extending from said first fold line the full width of said one half, said notch and said flap being of substantially like sizes whereby when said sheet is folded into doubled relation about said fold lines and remote ends of said halves connected together, said one half will have a juncture line spaced from the juncture line of the other of said halves, first transverse fold lines in said sheet dividing said other half into a plurality of panels combinable to form an enclosure, and second transverse fold lines in said sheet dividing said one half into a plurality of similar panels, like ones of said first and second transverse fold lines being in alignment with one another, said flap being hingedly connected to the remainder of said one half along a transverse fold line aligned with an adjacent side edge of said other half.

2. The blank of claim 1 wherein said halves are folded along said centrally disposed first fold line and opposed faces of said halves are bonded together by adhesive disposed on said other half only.

3. The blank of claim 2 wherein said other half defines the outer layer of the resultant lines, said transverse fold lines of said one half are defined by scores and said transverse fold lines of said other half are of the combined score and slot type wherein relatively thick material may be folded.

4. The blank of claim 2 wherein said sheet is formed of corrugated board and said first fold line is in the form of a slit through certain layers of said sheet, said slot being formed in that surface opposite from said adhesive.

5. A carton liner comprising a paperboard sheet folded upon itself and defining two opposed sheet portions of like size but longitudinally offset from one another, one of said sheet portions having a first edge recessed from an adjacent edge of the other of said sheet portions and a second edge projecting from an adjacent edge of said other sheet portion, adhesive securing together said sheet portions in face-to-face relation, and aligned transverse fold means in said sheet portions for effecting folding of said liner to an enclosing configuration, said fold means including a fold line in said one sheet portion aligned with said adjacent edge of said other sheet portion.

6. The carton liner of claim 5 wherein said liner is folded to its enclosing configuration and said one sheet portion projecting second edge forms part of an interior corner and is overlapped and secured by said adhesive to said other sheet portion in substantially opposed abutting relation to said one sheet portion first edge, said adhesive being on only said other sheet portion.

7. The carton liner of claim 6 wherein said one sheet portion defines an inner surface of said liner, and said fold means of said other sheet portions being primarily slots to facilitate folding of said liner.

8. A carton assembly comprising a carton member and a carton liner, said carton member including a carton body defined by a plurality of interconnected panels arranged in a predetermined configuration, and a carton liner tightly received in said carton body, adhesive means bonding said liner to inner surfaces of said body panels and reinforcing the same, said carton liner being in the form of a single paperboard sheet folded upon itself and defining two opposed sheet portions of like size but longitudinally offset from one another, one of said sheet portions having a first edge recessed from an adjacent edge of the other of said sheet portions and a second edge projecting from an adjacent edge of said other sheet portion, adhesive on only said other sheet portion securing together said sheet portions in face-to-face relation, said liner being folded to conform to the internal configuration of said carton body, and said one sheet portion second edge forming part of an interior corner and being overlapped and secured to said other sheet portion by said adhesive in substantially opposed abutting relation to said one sheet portion first edge.

9. The carton assembly of claim 8 wherein in said liner said other sheet portion is disposed outermost, and said other sheet portion having along each corner thereof openings facilitating the folding of said liner.

* * * * *